US008794445B2

(12) United States Patent
Wurth et al.

(10) Patent No.: US 8,794,445 B2
(45) Date of Patent: Aug. 5, 2014

(54) PACKAGING FOR STORING PRODUCTS AND METHODS OF MAKING AND USING SUCH PACKAGES

(75) Inventors: Stephen A. Wurth, St. Louis, MO (US); Yukihiro Urushidani, Webster Groves, MO (US); Bethanie Skinner, Edwardsville, IL (US); William Kumke, Webster Groves, MO (US)

(73) Assignee: Nestec SA, Vevey (CH)

( * ) Notice: Subject to any disclaimer, the term of this patent is extended or adjusted under 35 U.S.C. 154(b) by 367 days.

(21) Appl. No.: 12/736,788

(22) PCT Filed: May 13, 2009

(86) PCT No.: PCT/US2009/002974

§ 371 (c)(1),
(2), (4) Date: Jan. 27, 2011

(87) PCT Pub. No.: WO2009/139874

PCT Pub. Date: Nov. 19, 2009

(65) Prior Publication Data

US 2011/0162998 A1 Jul. 7, 2011

Related U.S. Application Data

(60) Provisional application No. 61/127,433, filed on May 13, 2008.

(51) Int. Cl.
*B65D 5/50* (2006.01)

(52) U.S. Cl.
USPC ..... 206/759; 206/747; 206/778; 206/782; 229/120.011; 229/164; 229/162.1

(58) Field of Classification Search
CPC .... B65D 5/0085; B65D 77/006; B65D 5/009; B65D 5/5253; B65D 5/5495
USPC ..... 206/759, 743, 497, 775–778, 782, 747; 229/106, 103, 120.011, 161, 162.1, 229/101.1
See application file for complete search history.

(56) References Cited

U.S. PATENT DOCUMENTS

| | | | | |
|---|---|---|---|---|
| 1,016,148 | A * | 1/1912 | Heinicke | 206/747 |
| 2,046,751 | A * | 7/1936 | Reichel | 206/745 |
| 2,315,999 | A * | 4/1943 | Holm | 206/750 |
| 3,322,263 | A * | 5/1967 | Gulliver | 206/497 |

(Continued)

FOREIGN PATENT DOCUMENTS

GB 2439066 A 12/2007

*Primary Examiner* — Luan K Bui
*Assistant Examiner* — Rafael Ortiz
(74) *Attorney, Agent, or Firm* — Julie M. Lappin; Robert M. Barrett; Aaron J. Morrow

(57) ABSTRACT

The invention provides packages for storing consumable products and methods for making and using same. The packages may include containers housed within a housing, which may include at least one viewable area in a wall of the housing to allow a consumer to see through at least a portion of the housing. The containers may also include at least one viewable area in a wall of the containers and the location of the viewable area may correspond to a location of the viewable area of the housing. The containers may also be connected such that the containers may be removed from the housing, rotated about a hinged connection, and placed on a shelf for storage.

20 Claims, 4 Drawing Sheets

(56) References Cited

U.S. PATENT DOCUMENTS 4,258,842 A * 3/1981 Falkstein ..... 206/8
4,457,431 A * 7/1984 Lundquist et al. ..... 229/101.1
6,386,369 B2 * 5/2002 Yuhas et al. ..... 206/746
7,370,761 B2 * 5/2008 Andersen et al. ..... 206/497

* cited by examiner

PACKAGING FOR STORING PRODUCTS AND METHODS OF MAKING AND USING SUCH PACKAGES

CROSS REFERENCE TO RELATED APPLICATIONS

This application is a national stage application under 35 U.S.C. §371 of PCT/US2009/002974 filed May 13, 2009, which claims priority to U.S. Provisional Application Ser. No. 61/127,433 filed May 13, 2008, the disclosures of which are incorporated herein by reference.

BACKGROUND OF THE INVENTION

1. Field of the Invention

The present invention relates generally to packages and packaging and particularly to packages and packaging useful for displaying and storing consumable products.

2. Description of Related Art

Packaging for consumable products is important both with respect to the marketing and storage of the products contained therein. As such, packages for consumable products come in a variety of sizes, shapes, and designs. With respect to marketing, variation of these characteristics can convey important information to the consumer including the product brand, flavor, or type of product contained within the package. Similarly, varying the sizes, shapes, and designs of the packaging may also provide advantages with respect to storage of the product. For example, packaging can often be bulky and require large amounts of shelf space to be stored by the consumer. Since many packages do not meet these requirements, there is, therefore, a need for new an innovative packaging that allows the consumer to view the product form various perspectives and that can be manipulated to conserve shelf space.

SUMMARY OF THE INVENTION

The present invention provides packages for storing and marketing consumable products and methods of making and using such packages. In particular, the packages of the present invention may be used to increase marketability of the products contained in the packages and to reduce the amount of space required to store the packages.

In an embodiment, the invention provides a package comprising a first container having a front wall and a back wall hingedly connected to a second container having a front wall and a back wall between at least a first position and a second position. The front walls of the first and second containers may be oriented in opposing directions in the first position and in a same direction in the second position. The first and second containers may be hingedly connected by a connection having a characteristic selected from the group consisting of perforations, etching, weakened portions, or combinations thereof.

In an embodiment, the containers include at least one viewable area. The viewable areas include a portion of the package wherein a consumer can see through the portion of the package. For example, the viewable areas may be a hole defined by a portion of the package, a window with a transparent material, or the like. The viewable area may be located on the housing, the containers, or combinations thereof.

In an embodiment, the containers may house a plurality of products, including products in other types of packages containing the products.

In another embodiment, the invention provides a package comprising a first container including a back wall having a first viewable area and a second container hingedly connected to the first container and including a back wall with a second viewable area. The first and second containers may be hingedly connected by a connection having a characteristic selected from the group consisting of perforations, etching, weakened portions, or combinations thereof.

In an embodiment, the containers may include at least one viewable area. The viewable areas may include a portion of the package wherein a consumer can see through the portion of the package. For example, the viewable areas may be a hole defined by a portion of the package, a window with a transparent material, or the like.

In an embodiment, the containers may house a plurality or products, including products in other types of packages containing the products.

In yet another embodiment, the invention provides a package comprising at least two containers hingedly connected to each other, each of the at least two containers including two side walls, a back wall and a front wall. Each of the side walls may include a curved portion extending downwardly from a back wall to a front wall. The curved portion may extend from a top of the back wall to a top of the front wall. The at least two containers may be hingedly connected by a connection having a characteristic selected from the group consisting of perforations, etching, weakened portions, or combinations thereof.

In an embodiment, the containers may include at least one viewable area. The viewable areas may include a portion of the package wherein a consumer can see through the portion of the package. For example, the viewable areas may be a hole defined by a portion of the package, a window with a transparent material, or the like. The viewable area may be located on the housing, the containers, or combinations thereof.

In an embodiment, the containers may house a plurality or products, including products in other types of packages containing the products. The plurality of products or packages may have a height that is greater than a height of the front walls of the at least two containers.

In still yet another embodiment, the invention provides a package comprising a housing having at least one viewable area at a first location, at least two connected containers housed within the housing and having at least one viewable area at a second location corresponding to the first location, and a package having indicia thereon. The indicia of the package may be visible through both the viewable area at the first location and the viewable area at the second location.

In an embodiment, the containers and/or the housing may include at least one viewable area. The viewable areas may include a portion of the package wherein a consumer can see through the portion of the package. For example, the viewable areas may be a hole defined by a portion of the package, a window with a transparent material, or the like. The viewable area may be located on the housing, the containers, or combinations thereof.

In an embodiment, the containers may house a plurality or products, including products in other types of packages containing the products. The packages may include indicia that are indicative of a property of a consumable product contained within the packages. A location of the indicia may correspond to a location of a viewable area. The location of the viewable area may include viewable areas on the housing, the containers, or combinations thereof. For example, in an embodiment, the location of the indicia corresponds to the location of the viewable areas on the containers. Similarly, in an embodiment, the locations of the indicia and the location of the viewable areas on the containers correspond to the location of the viewable areas on the housing.

In another embodiment, the invention provides a package comprising a housing having at least one viewable area at a first location and at least two hingedly connected containers housed within the housing and having at least one indicia at a second location corresponding to the first location.

In an embodiment, the containers and/or housing may include at least one viewable area. The viewable areas may include a portion of the package wherein a consumer can see through the portion of the package. For example, the viewable areas may be a hole defined by a portion of the package, a window with a transparent material, or the like. The viewable area may be located on the housing, the containers, or combinations thereof.

In an embodiment, the housing includes two viewable areas. The two viewable areas may be located at opposing ends of the housing and on opposing walls of the housing.

In yet another embodiment, the invention provides a method for storing products in a package. The method comprises removing a first container and a second container from a housing, wherein the first container is hingedly connected to the second container, rotating the second container from a first position, wherein the first and second containers are oriented in opposing directions, to a second position, wherein the first and second containers are in a same direction, and storing the first and second containers in the second position.

In an embodiment, the rotating occurs about a vertical axis defined by the hinged connection.

In an embodiment, the first and second containers are stored on a pantry shelf.

In still yet another embodiment, the invention provides a method for displaying products in a package. The method comprises housing at least two connected containers in a housing, the containers including at least one viewable area, aligning the at least one viewable area of the containers with at least one viewable area of the housing, and displaying the package. The package may be displayed in a position selected from the group consisting of vertical, horizontal, or combinations thereof.

In an embodiment, the containers and/or housing may include at least one viewable area. The viewable areas may include a portion of the package wherein a consumer can see through the portion of the package. For example, the viewable areas may be a hole defined by a portion of the package, a window with a transparent material, or the like. The viewable area may be located on the housing, the containers, or combinations thereof.

In an embodiment, the method includes packaging a consumable product in a package. The package may then be inserted into at least one of the first and second containers. The at least one of the first and second containers may then be inserted into the housing.

In another embodiment, the invention provides a method for displaying products in a package. The method comprises housing at least two connected containers in a housing, the containers including at least one indicia, aligning the at least one indicia of the containers with at least one viewable area of the housing, and displaying the package. The package may be displayed in a position selected from the group consisting of vertical, horizontal, or combinations thereof.

In an embodiment, the containers and/or housing may include at least one viewable area. The viewable areas may include a portion of the package wherein a consumer can see through the portion of the package. For example, the viewable areas may be a hole defined by a portion of the package, a window with a transparent material, or the like. The viewable area may be located on the housing, the containers, or combinations thereof.

In an embodiment, the method includes packaging a consumable product in a package. The package may then be inserted into at least one of the first and second containers. The at least one of the first and second containers may then be inserted into the housing.

Advantages of embodiments of the present invention will now be set forth. It should be noted that not all of these advantages may be met by any specific embodiment of the present invention. An advantage of the present invention is to provide an improved package. It, is also an advantage of the present invention to provide an improved package for storing a product. Another advantage of the present invention is to provide an improved package for reducing the required storage space of the package. Still yet another advantage of the present invention is to provide a package capable of being stored in different configurations. It is also an advantage of the present invention to provide an improved package for marketing a product. It is a further advantage of the present invention to provide improved methods for storing a package. Another advantage of the present invention is to provide improved methods for marketing products in a package.

Other and further objects, features, and advantages of the invention will be readily apparent to those skilled in the art.

DETAILED DESCRIPTION OF THE INVENTION

The present invention generally provides packages, methods for marketing products contained in packages, and methods for storing products contained in packages. More specifically, the present invention provides packages for containing consumable products that improve the marketability of the products and reduce the amount of space required to store the products. For example, the packages are designed to provide a unique viewable area, or combinations of viewable areas, that allow the consumer to visually identify a property or characteristic associate with the product by looking through the viewable area of the package. Moreover, the packages may also be arranged such that the amount of storage space required to store the product on, for example, a pantry shelf after a consumer purchases the product is reduced. Specifically, the packages may be hingedly connected between a first position, upon being removed from a housing, and a second position to be stored by the consumer.

Figure 1:
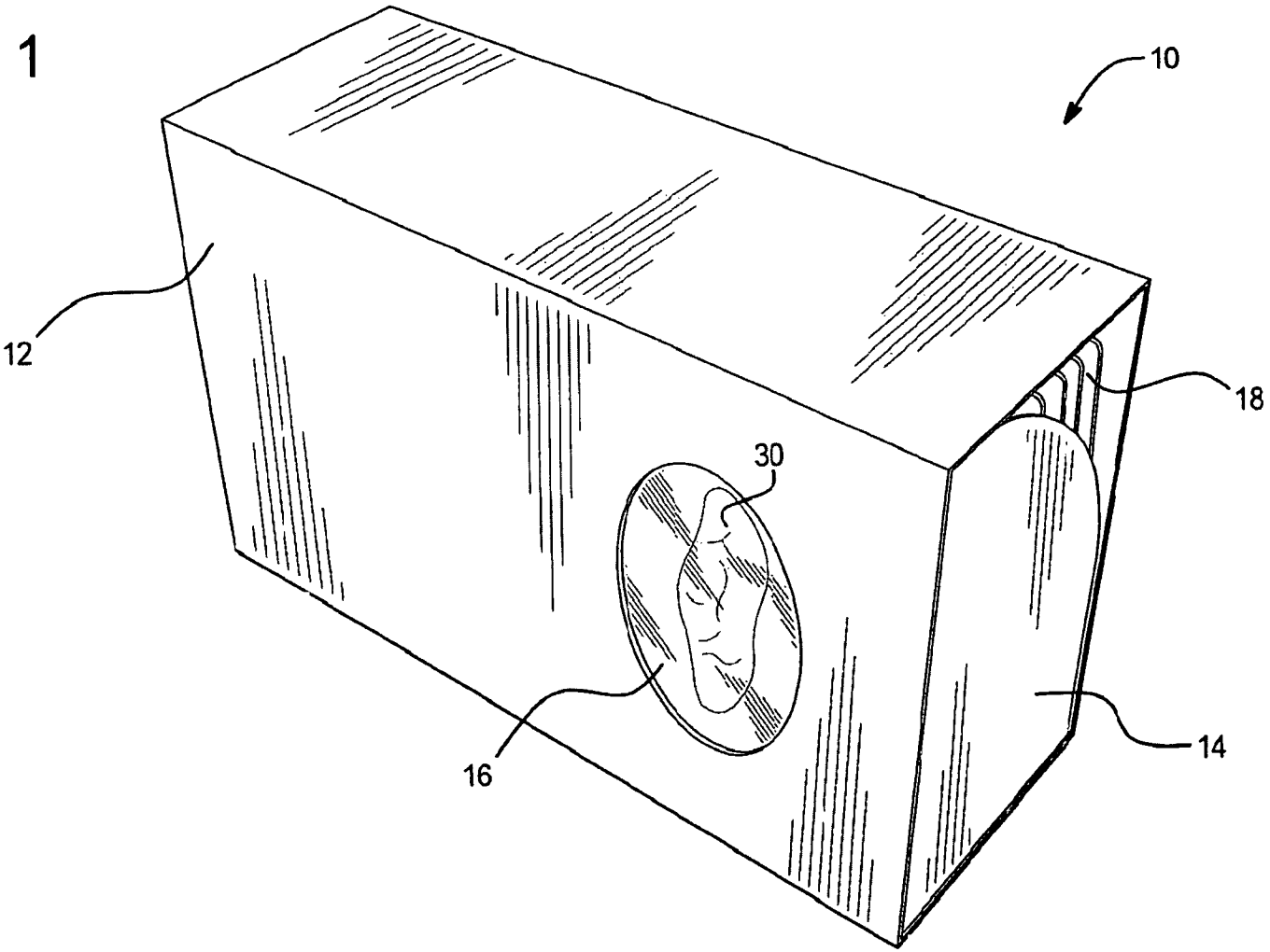
FIG. 1 illustrates a package in accordance with an embodiment of the present invention.

As shown in FIG. 1, an embodiment of a package of the present invention is generally designated by the numeral 10. The package 10 includes a housing 12 that houses at least one container 14 and includes at least one viewable area 16. Similarly, the container 14 may also include at least one viewable area, as will be further discussed below. As shown in FIG. 1, the container 14 may house one or more packages 18, which may serve as individual storage packages for the product that is intended to be stored by package 10.

The housing 12 may be manufactured from any material known in the art and used for manufacturing packages. For example, the housing 12 may be formed from any suitable material including, but not limited to, plastic, foil, composites, paper, paperboard, cardboard, and the like, and combinations thereof. In an embodiment, the housing 12 is formed from a paperboard material. Similarly, the housing 12 may take on any shape or size and should not be limited to any particular size or shape, so as long as the container(s) 14 are able to be housed therein.

As shown in FIG. 1, in an embodiment, the housing 12 is generally shaped as a rectangular sleeve. However, the housing 12 may be any suitable size and shape including, but not limited to, cubic, rectangular, pyramidal, cylindrical, conical, spherical shapes, and combinations thereof. Similarly, the housing 12 need not necessarily be a sleeve that has two open ends. Instead, the housing 12 may take any form including, but not limited to, a box that completely encloses the container(s) 14, a sleeve having two open ends, a compartment having one open side or end, or the like, and combinations thereof. As such, the skilled artisan will appreciate that the dimensions and shape of the housing 12 may vary as desired.

The housing 12 of the present invention may also have any number of viewable areas 16. Providing viewable areas 16 in the package 10 allows a consumer to see an indicia 30 through a portion of the package 10 and to quickly identify a property or characteristic that is associated with the product. As such, the indicia 30 may be indicative of a property or characteristic of the product contained within the package 10. Moreover, the ability of a manufacturer to vary the features of the indicia 30 may help to draw the consumer's attention to the product, thereby increasing consumer appeal in the product.

As used herein, a viewable area 16 is an area of the packaging that allows a consumer to see through at least a portion of the packaging. For example, a viewable area 16 may include, but is not limited to, a hole, a cut-out, a window having a transparent material, and the like, and combinations thereof. The viewable area 16 may also include, for example, any number of holes, cut-outs, or windows having transparent materials, so long as a consumer is able to see through at least the portion of the packaging corresponding to the location of the viewable area 16. In an embodiment, the housing 12 includes a viewable area 16 that is a hole defined by the housing 12. In another embodiment, the housing 12 includes a viewable area 16 that is a window having a transparent material. The transparent material may be any see-through material that will allow a consumer to see though a portion of the package. For example, the transparent material may be any plastic, glass, composite material, and the like, and combinations thereof. Further, the transparent material may also be tinted with a color.

Figure 2:
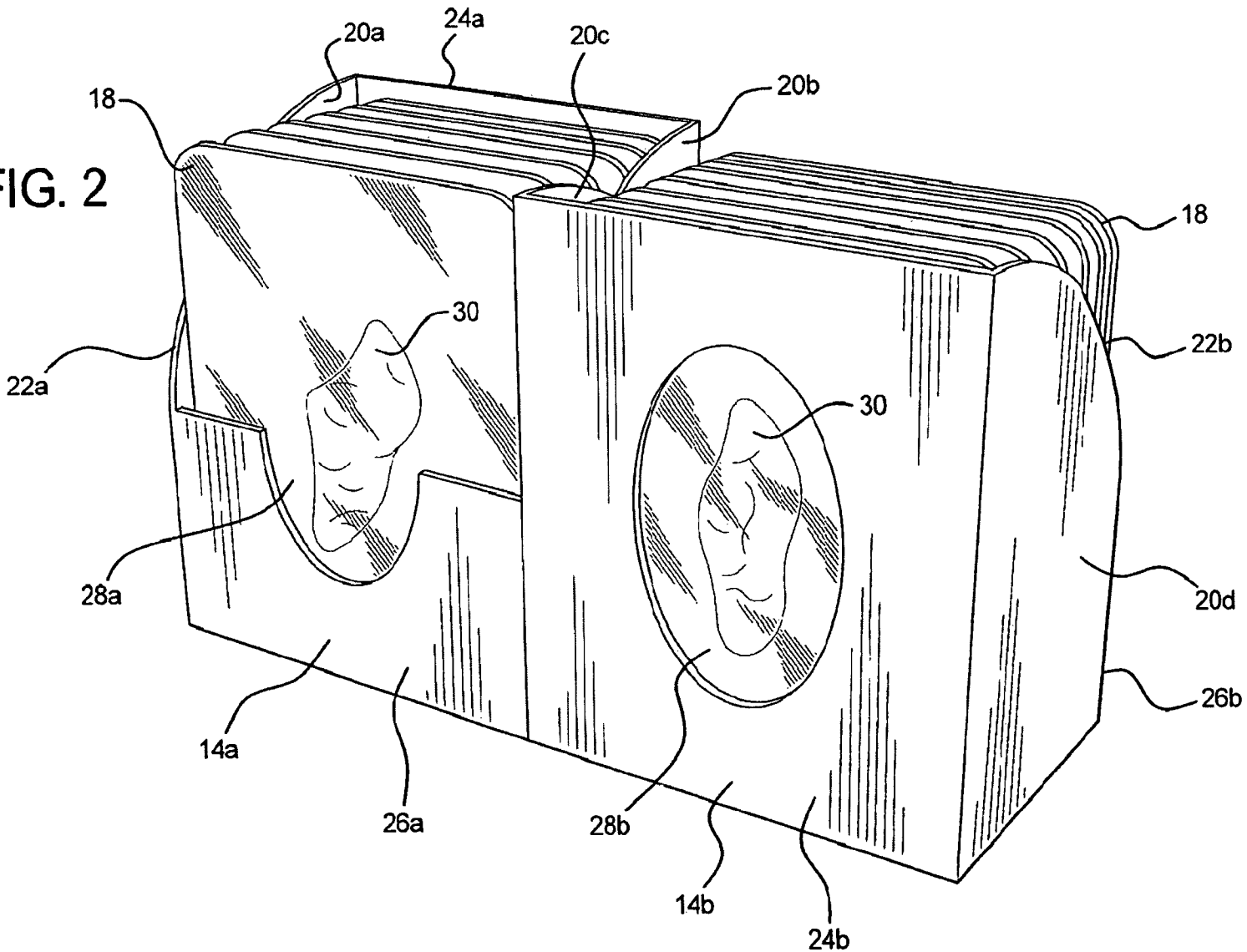
FIG. 2 illustrates two containers positioned in a side-by-side arrangement in accordance with an embodiment of the present invention.
Figure 4:
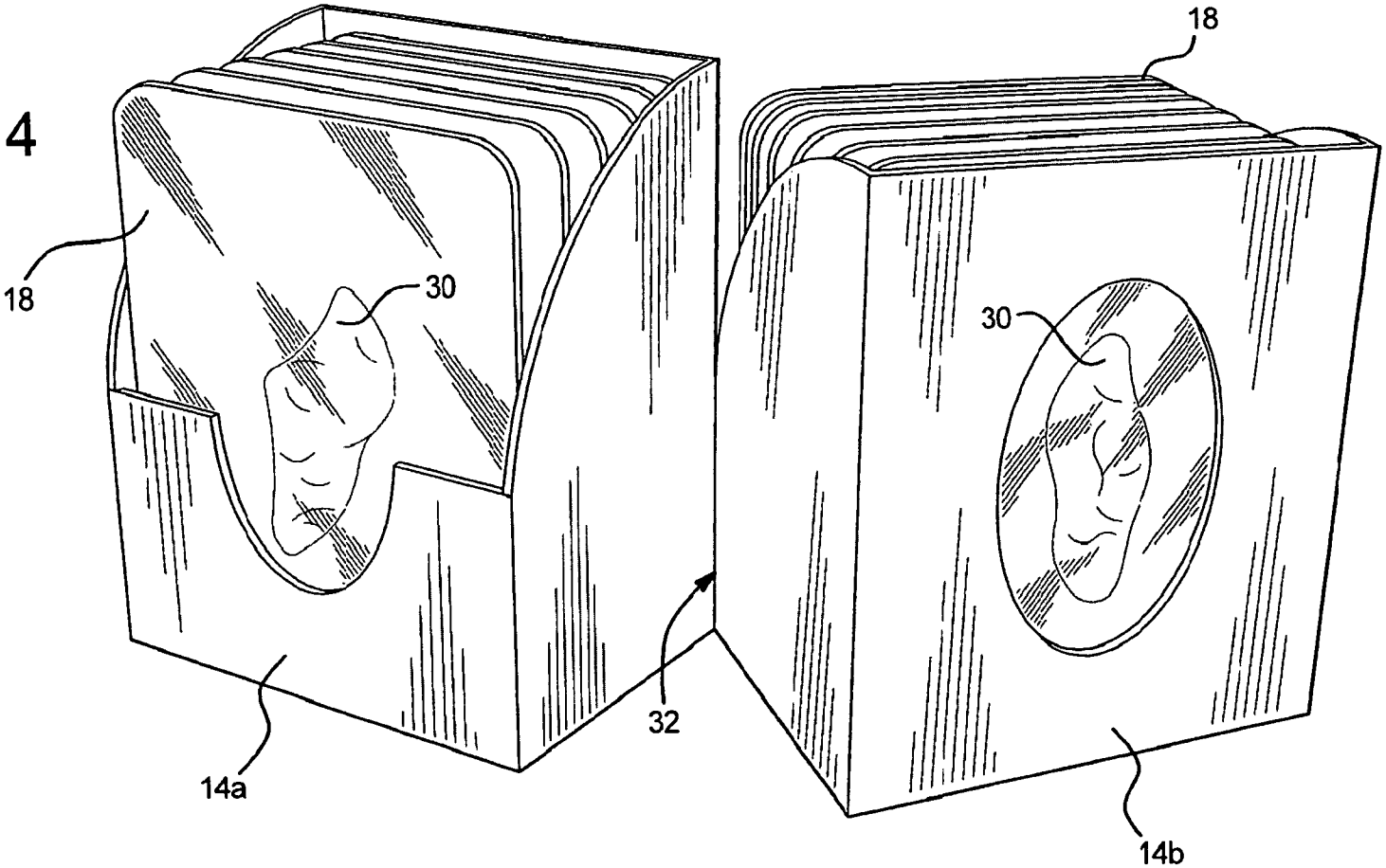
FIG. 4 illustrates two connected containers in accordance with an embodiment of the present invention.

Although the viewable areas 16 shown in FIGS. 1-2 and 4 are shown as windows having transparent materials, the skilled artisan will appreciate that the form and dimensions of the viewable areas 16 may vary as desired. Accordingly, the viewable areas 16 are not limited to any particular size or shape as long as the viewable areas 16 allow a consumer to see through a portion of the package. For example, the viewable areas 16 may have any shape including, but not limited to, cylindrical, conical, circular, semi-circular, elliptical, semi-elliptical, a biconvex lens or football shape, a crescent, or any polygon such as, for example, a square, rectangle, triangle, etc., and combinations thereof. Similarly, the viewable areas 16 may take any form including, but not limited to, holes, cut-outs, windows, or the like, as described above.

Since the viewable areas 16 are designed to allow a consumer to see through a portion of the package 10, in an embodiment, the viewable areas 16 of the housing 12 may be designed to allow a consumer to see through the housing 12. For example, FIG. 1 illustrates a viewable area 16 in the housing 12 that is a window having a transparent material that allows a consumer to see through the housing 12 to see the indicia 30. The indicia 30 may be located on a wall of the containers 14 such that the indicia 30 may be visible through the viewable area 16 of the housing 12 when the containers 14 are inside the housing 12. In order for the indicia 30 to be viewable through the viewable area 16, however, the location of the indicia 30 on the wall of the container 14 must correspond to a location of the viewable area 16 on the housing 12.

Alternatively, the indicia 30 may be located on one or more packages 18 that are located within the container 14. The packages 18 may be any packages known in the art for individually wrapping and/or sealing packages that are used to store the products. For example, packages 18 may be individually scaled packages containing consumable products including but not limited to, pet foods. The skilled artisan will appreciate, however, that the packages 18 may be used to package or store any type of consumable food product.

In an embodiment where the indicia 30 is located on one or more packages 18, both the housing 12 and the containers 14 may have viewable areas 16, 28. Moreover, in an embodiment where the indicia 30 is located on one or more packages 18, the location of the indicia 30 on the packages 18, the location of a viewable area 28 of the container 14, and the location of a viewable area 16 of the housing 12 must all correspond to each other. For example, in an embodiment wherein indicia 30 is located on the packages 18, FIG. 1 illustrates how the viewable area 16 of the housing 12, a viewable area 28 (not shown in FIG. 1) of the container 14, and indicia 30 all align in such a manner that indicia 30 is visible through viewable area 28 of the container 14 and the viewable area 16 of the housing 12.

The indicia 30 may depict any symbol, object, alpha-numeric representation, letter, word, text, shape, fanciful shape, image, graphic, color, advertising indicia, nutritional information, ingredient information, manufacturer information, barcoding, or product identifiers or combinations thereof as desired. As such, the indicia 30 may be indicative of a property, characteristic, aspect, attribute, component, element, quality, etc. that is associate with the product contained in the package 18. For example, FIG. 1 illustrates an indicia 30 that is indicative of the type of product contained in the plurality of packages 18 in the containers 14. Specifically, the indicia 30 of FIG. 1 may represent that the product contained within the packages 18 is a pet food product that is, for example, fish-flavored.

However, the indicia 30 of FIG. 1 may be any indicia 30 relating to the product contained in the packages 18. For example, the indicia 30 may be a chicken to indicate that the product contained in the packages 18 is chicken-flavored. Similarly, the indicia 30 may also be dog to indicate that the product is a pet food intended for dogs. Further, the indicia 30 may also be a brand that is associated with a company that manufactures, for example, a pet food.

The container(s) 14 of FIG. 1 may be removed from the housing 12 by either gripping the containers 14 and pulling the containers 14 out of the housing 12, or by pushing the containers 14 out of the housing 12. In an embodiment, the housing 12 of the present invention is designed to house at least two containers 14. However, the skilled artisan will appreciate that the housing 12 may house any number of containers 14 including, for example, more or less than two containers 14.

The containers 14 may be manufactured from any material known in the art and used for manufacturing packages, as discussed above. For example, the containers 14 may be formed from any suitable material including, but not limited to, plastic, foil, composites, paper, paperboard, cardboard, and the like. In an embodiment, the containers 14 are formed from a paperboard material.

The containers 14 are not limited to any particular size or shape as long as the containers 14 are able to be housed within the housing 12. As shown in FIG. 1, the housing 12 may be generally shaped as a rectangular sleeve. As such, the containers 14 may also be generally rectangular or cubic shapes. For example, FIG. 2 illustrates an embodiment of the present invention having two containers 14*a*, 14*b* that have been removed from the housing 12. The containers 14*a*, 14*b* are generally rectangularly shaped. However, the skilled artisan will appreciate that the containers 14*a*, 14*b* may be any suitable size and shape including, but not limited to, cubic, rectangular, pyramidal, cylindrical, conical, spherical shapes, and combinations thereof. Accordingly, the housing 12 may also be any suitable size and shape, as discussed above.

As shown in FIG. 2, the generally rectangularly shaped containers 14*a*, 14*b* of an embodiment of the present invention may have a slightly modified rectangular shape. For example, each side panel 20*a*, 20*b*, 20*c*, 20*d* of the containers 14*a*, 14*b* may include a curved portion 22*a*, 22*b* extending from a back wall 24*a*, 24*b* of the containers 14*a*, 14*b* to a front wall 26*a*, 26*b* of the containers 14*a*, 14*b*. The curved portion 22*a*, 22*b* may have any degree of curvature and may extend from any location along, the back wall 24*a*, 24*b* of the containers 14*a*, 14*b* to any location along the front wall 26*a*, 26*b* of the containers 14*a*, 14*b*. In an embodiment, and as shown in FIG. 2, the curved portion 22*a*, 22*b* extends from the top of the back wall 24*a*, 24*b* of the containers 14*a*, 14*b* to the top of the front wall 26*a*, 26*b* of the containers 14*a*, 14*b*.

Similarly, the front walls 26*a*, 26*b* and the back walls 24*a*, 24*b* of the containers 14*a*, 14*b* may have any height. For example, the front walls 26*a*, 26*b* and the back walls 24*a*, 24*b* may be the same height. Alternatively, the front walls 26*a*, 26*b* and the back walls 24*a*, 24*b* may have different heights. In an embodiment, the height of the back walls 24*a*, 24*b* of the containers 14*a*, 14*b* is greater than the front walls 26*a*, 26*b* of the containers 14*a*, 14*b*, as is shown in FIG. 2. Although the Figures illustrate an embodiment wherein the height of the back walls 24*a*, 24*b* of the containers 14*a*, 14*b* is greater than the front walls 26*a*, 26*b* of the containers, the skilled artisan will appreciate that the containers 14 may have walls 24*a*, 24*b*, 26*a*, 26*b* of any height.

The curved portions 22*a*, 22*b* of containers 14*a*, 14*b*, either alone or in combination with the difference the height between the back walls 24*a*, 24*b* of the containers 14*a*, 14*b* and the front walls 26*a*, 26*b* of the containers 14*a*, 14*b*, may provide added benefits to the design of the package 10. For example, and as mentioned previously, in order to remove the container 14 from the housing 12, a consumer may be required to pull the container 14 out of the housing 12. Alternatively, a consumer may also be able to push the container 14 out of an opposite side of the housing 12. However, in an embodiment wherein the consumer desires, or is required, to pull the container 14 out of the housing 12, the curved portions 22*a*, 22*b* of the containers 14*a*, 14*b* may allow the consumer to sufficiently grip the container 14*a*, 14*b* in order to do so, as is shown by FIG. 1.

Further, the curved portions 22*a*, 22*b* of the containers 14*a*, 14*b* may provide a consumer with easy access to the packages 18 when the containers 14*a*, 14*b* have been removed from the housing 12. For example, in an embodiment, the packages 18 may have a height that is greater than the height of the container 14*a* at the curved portion 22*a*, as is shown by FIG. 2. As such, the consumer may be able to easily grip either side of the packages 18 that are positioned near the front wall 26*a* of the container 14*a* to lift the packages 18 out of the container 14*a* without the side walls 20*a*, 20*b* of the container 14*a* obstructing such action.

The containers 14 of the present invention may also have any number of viewable areas 28. The viewable areas 28 of the containers 28 are similar to the viewable areas 16 already discussed with respect to the housing 12. As such, a viewable area 28 is an area of the packaging that allows a consumer to see through at least a portion of the packaging. For example, a viewable area 28 may include, but is not limited to, a hole, a cut-out, a window having a transparent material, or the like. The viewable area 28 may also include, for example, any number of holes, cut-outs, or windows having transparent materials, so long as a consumer is able to see through at least a portion of the packaging. In an embodiment, and as shown in FIG. 2, the viewable areas 28*a*, 28*b* may be, respectively, a semi-circular hole defined by the front wall 26*a* of the first container 14*a* and a window having a transparent material in the back wall 24*b* of the second container 14*b*.

Although FIG. 2 illustrates the first container 14*a* as having a semi-circular hole and the second container 14*b* as having a window with a transparent material, the skilled artisan will appreciate that the form and dimensions of the viewable areas 28 may vary as desired or in accordance with manufacturing specifications. Accordingly, the viewable areas 28 are not limited to any particular size or shape as long as the viewable areas 28 allow a consumer to see through a portion of the package. For example, the viewable areas 28 may have any shape including, but not limited to, cylindrical, conical, circular, semi-circular, elliptical, semi-elliptical, a biconvex lens or football shape, a crescent, or any polygon such as, for example, a square, rectangle, triangle, etc., and combinations thereof. Similarly, the viewable areas 28 may take any form including, but not limited to, holes, cut-outs, windows, or the like, as described above.

As discussed above with respect to viewable areas 16 of the housing 12, the viewable areas 28*a*, 28*b* of the containers 14*a*, 14*b* also allow consumers to sec indicia 30 through a portion of the package 10. Specifically, viewable areas 28*a*, 28*b* allow consumers to see the indicia 30 through the containers 14*a*, 14*b*. The indicia 30 may be any form of the indicia 30 discussed herein above with respect to FIG. 1. As such, the skilled artisan will appreciate that the indicia 30 may convey any information to the consumer regarding the product contained in the packages 18.

FIG. 2 also illustrates an embodiment of the present invention having two containers 14*a*, 14*b* arranged in a first position, which may represent the arrangement of the containers 14*a*, 14*b* within the housing 12 and immediately after the containers 14*a*, 14*b* are removed from the housing 12. As shown by FIG. 2, the first container 14*a* is arranged such that the front 26*a* of the container 14*a* is facing forward. Alternatively, the second container 14*b* is arranged such that the back 24*b* of the container 14*b* is facing forward. As such, FIG. 2 demonstrates that the containers 14*a*, 14*b* may be positioned within the housing 12 in a side-by-side arrangement and oriented in opposing directions. Similarly, the containers 14*a*, 14*b* may also be positioned in the same, or substantially the same, side-by-side arrangement and oriented in opposing directions immediately after being removed from the housing 12.

Although FIG. 2 illustrates an embodiment of the present invention wherein the containers 14*a*, 14*b* are positioned side-by-side and having the front walls 26*a*, 26*b* oriented in opposing directions, the skilled artisan will appreciate that the containers 14*a*, 14*b* need note be arranged in such an arrangement. For example, the containers 14*a*, 14*b* may be arranged within the housing 12 and immediately after being, removed therefrom in a side-by-side arrangement and having the front walls 26*a*, 26*b* oriented in the same direction. Similarly, the containers 14*a*, 14*b* may also be arranged within the housing 12 and immediately after being removed therefrom in a front-to-back arrangement and having the front walls 26*a*, 26*b* oriented in the same direction. The containers 14*a*, 14*b* may also be arranged within the housing 12 and immediately after being removed therefrom in a front-to-back arrangement and having the front walls 26*a*, 26*b* oriented in opposing directions.

Figure 3:
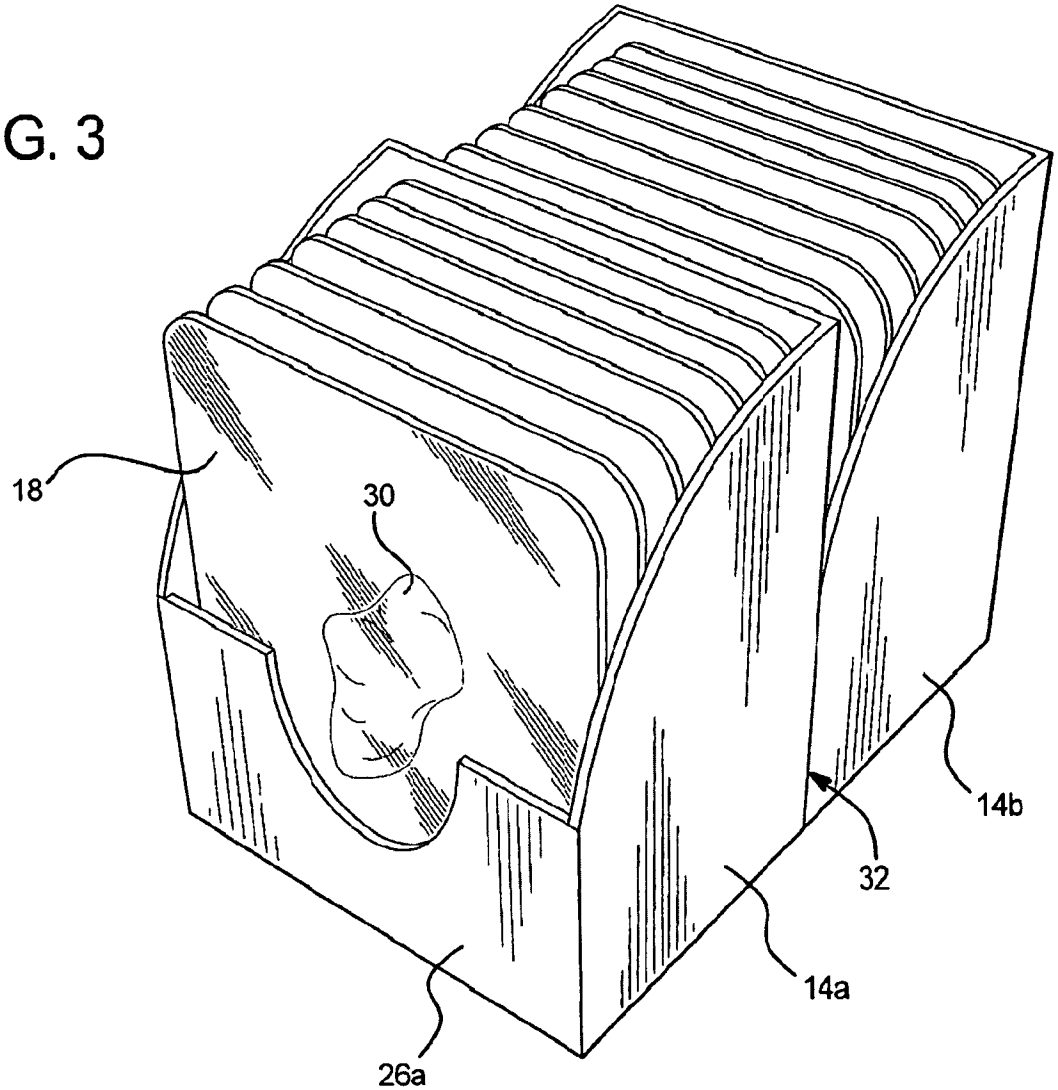
FIG. 3 illustrates two containers positioned in a front-to-back arrangement in accordance with an embodiment of the present invention.

Just as FIG. 2 illustrates the first container 14*a* and the second container 14*b* arranged in a first position wherein the containers 14*a*, 14*b* are side-by-side, the containers 14*a*, 14*b* may also be arranged in a second position wherein the containers 14*a*, 14*b* are arranged front-to-back and wherein the front walls 26*a*, 26*b* of the containers 14*a*, 14*b* are oriented in the same direction, as shown in FIG. 3. To arrange the containers 14*a*, 14*b* in the second position, the containers 14*a*, 14*b* may be hingedly connected, as is shown in FIG. 4. As such, the second container 14*b* may be rotated about an axis defined by a hinged connection 32 from a first position to the second position, as shown in FIG. 4.

In an embodiment, the containers 14*a*, 14*b* of the present invention may be formed from one single piece of material that is folded and adhered to portions of itself to form the at least two individual containers 14*a*, 14*b*. As such, the hinged connection 32 may be formed from the same piece of material that is used to form either portions of the containers 14*a*, 14*b*, or the complete construction of the containers 14*a*, 14*b*. In another embodiment, the at least two containers 14*a*, 14*b* may be formed separately from each other and joined by a hinged connection 32 formed of a separate material.

Regardless, however, the hinged connection 32 may include structural characteristics that are introduced either during or after manufacturing of the containers 14*a*, 14*b* that may allow a consumer to easily separate the first container 14*a* from the second container 14*b*. For example, the hinged connection 32 may include characteristics such as perforations, etching, weakened portions, and the like, and combinations thereof. The ability to separate the containers 14*a*, 14*b* will provide the consumer with a greater amount of flexibility and control over the amount of space required to store the products contained in the packages 18 of the containers 14*a*, 14*b*. Similarly, the consumer may also choose to store only one container 14 on a pantry shelf so as to be visible and easily accessible by the consumer, while storing the remaining container 14 in a cupboard or another separate location.

Therefore, in an embodiment, the containers 14*a*, 14*b* of the present invention may be removed from the housing 12 in a first position wherein the first container 14*a* and the second container 14*b* are oriented in opposing directions. However, the second container 14*b* may rotated about a hinged connection 32 in order to orient the containers 14*a*, 14*b* in the same direction. Orienting the containers 14*a*, 14*b* in the same direction provides the consumer the advantage of requiring less lateral storage space after removing the containers 14*a*, 14*b* from the housing 12.

Further, the ability to rotate the second container 14*b* to face the same direction, and the ability to break the connection between the first container 14*a* and the second container 14*b* allows the consumer to easily replace the first container 14*a* with the second container 14*b* after all of the packages 18 stored in the first container 14*a* have been used by the consumer.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

What is claimed is:

1. A package comprising:

a first container having a front wall and a back wall hingedly connected to a second container having a front wall and a back wall between at least a first position and a second position, the front walls of each of the first and second containers oriented in opposing directions in the first position and a same direction in the second position, the first container hingedly connected to the second container by a connection of the back wall of the first container to the front wall of the second container, the height of the back wall being greater than the front wall for each of the containers, the front wall of the second container positioned against the back wall of the first container when in the second position, the back wall of the first container comprising a first viewable area surrounded by the remainder of the back wall of the first container; and a housing in which the first and second containers are positioned, the housing comprising a housing wall comprising a second viewable area aligned with the first viewable area when the first and second containers are positioned within the housing, the second viewable area is a structure selected from the group consisting of (i) a window surrounded by the remainder of the housing wall and having a transparent material which is a different material than the remainder of the housing wall and (ii) a hole surrounded by the remainder of the housing wall, and the first container contains at least one item having indicia aligned with the first and second viewable areas when the first and second containers are positioned within the housing.

2. The package of claim 1 wherein the connection has a characteristic selected from the group consisting of perforations, etching, weakened portions, and combinations thereof.

3. The package of claim 1 wherein the first container comprises the first viewable area, and the second container comprises a third viewable area, the housing comprising a fourth viewable area aligned with the third viewable area when the first and second containers are positioned within the housing, the second and fourth viewable areas located in opposite walls of the housing relative to each other.

4. The package of claim 1 wherein, and the top of the window of the second viewable area is lower than the height of the back walls of the first and second containers.

5. The package of claim 1 wherein the first viewable area comprises a hole in the back wall of the first container.

6. The package of claim 1 wherein the first container houses a first plurality of items that includes the at least one item having the indicia, each of the first plurality of items being positioned a different distance from the front wall of the first container, and the second container houses a second plurality of items, each of the second plurality of items being positioned a different distance from the front wall of the second container.

7. A package comprising:

a first container comprising a wall having a first viewable area; and a second container hingedly connected to the first container and comprising a wall with a second viewable area, the first viewable area and the second viewable area oriented to face in opposing directions in a first position of the first container relative to the second container and a same co-linear direction in a second position of the first container relative to the second container, each of the first and second viewable areas is surrounded by the remainder of the wall; and a housing in which the first and second containers are positioned, the housing comprising a first housing wall comprising a third viewable area and a second housing wall opposite to the first housing wall and comprising a fourth viewable area, the third viewable area and the fourth viewable area aligned with the first viewable area and the second viewable area, respectively, when the first and second containers are positioned within the housing, the third viewable area is a structure selected from the group consisting of (i) a window surrounded by the remainder of the first housing wall and having a transparent material which is a different material than the remainder of the first housing wall and (ii) a hole surrounded by the remainder of the first housing wall, and the first container contains at least one item having indicia aligned with the first and third viewable areas when the first and second containers are positioned within the housing.

8. The package of claim 7 wherein the first and second containers are hingedly connected by a connection having a characteristic selected from the group consisting of perforations, etching, weakened portions, and combinations thereof.

9. The package of claim 7 wherein at least one of the first and second viewable areas comprise windows having transparent materials.

10. The package of claim 7 wherein each of the first and second viewable areas comprises a hole in the back wall of the first container and the back wall of the second container, respectively, and the hole is surrounded by the remainder of the corresponding back wall.

11. The package of claim 7 wherein the first container houses a first plurality of items, each of the first plurality of items being positioned a different distance from the wall having the first viewable area, and the second container houses a second plurality of items, each of the second plurality of items being positioned a different distance from the wall having the second viewable area, at least one of the first plurality of items comprising indicia aligned with the first viewable area and the third viewable area when the first and second containers are positioned within the housing, and at least one of the second plurality of items comprising indicia aligned with the second viewable area and the fourth viewable area when the first and second containers are positioned within the housing.

12. The package of claim 7 wherein the fourth viewable area is a structure selected from the group consisting of (i) a window surrounded by the remainder of the second housing wall and having a transparent material which is a different material than the remainder of the second housing wall and (ii) a hole surrounded by the reminder of the second housing wall.

13. A package comprising:

at least two containers hingedly connected to each other, each of the at least two containers comprising two side walls, a back wall and a front wall, wherein each of the side walls comprise a curved portion extending downwardly from the back wall to the front wall, the front wall of one of the containers hingedly connected to the back wall of a different one of the containers by a connection, at least one of the containers comprising a first viewable area, the first viewable area is surrounded by the remainder of the corresponding back wall; and a housing in which the containers are positioned, the housing comprising a housing wall comprising a second viewable area aligned with the first viewable area when the containers are positioned within the housing, the second viewable area is a structure selected from the group consisting of (i) a window surrounded by the remainder of the housing wall and having a transparent material which is a different material than the remainder of the housing wall and (ii) a hole surrounded by the remainder of the housing wall, and the containers contain at least one item having indicia aligned with the first and second viewable areas when the containers are positioned within the housing.

14. The package of claim 13 wherein the curved portion extends from the top of the back wall to the top of the front wall.

15. The package of claim 13 wherein the connection has a characteristic selected from the group consisting of perforations, etching, weakened portions, and combinations thereof.

16. The package of claim 13 wherein the at least two containers comprise a first container comprising the first viewable area and a second container comprising a third viewable area, the housing comprising a fourth viewable area aligned with the third viewable area when the first and second containers are positioned within the housing, the second and fourth viewable areas located in opposite walls of the housing relative to each other.

17. The package of claim 13 wherein, and the top of the window of the second viewable area is lower than the tops of the back walls of the containers.

18. The package of claim 13 wherein the first viewable area comprises a hole in a wall of the at least one of the containers, the hole surrounded by the remainder of the wall.

19. The package of claim 13 wherein the at least two containers house a plurality of items, at least one of the plurality of items comprising indicia aligned with the first viewable area and the second viewable area when the containers are positioned within the housing.

20. The package of claim 19 wherein the plurality of items have a height that is greater than the height of the front walls of the at least two containers.

* * * * *